US005141268A

United States Patent [19]

Keller

[11] Patent Number: 5,141,268

[45] Date of Patent: Aug. 25, 1992

[54] SAFETY DOOR LATCH BOLT

[76] Inventor: Gary Keller, 1000 S. Broadway, Salem, Ohio 44460

[21] Appl. No.: 765,303

[22] Filed: Sep. 25, 1991

[51] Int. Cl.[5] ..... E05C 1/16

[52] U.S. Cl. ..... 292/150; 292/169.14

[58] Field of Search ..... 292/150, 169.14, 169.18, 292/169.21, DIG. 65

[56] References Cited

U.S. PATENT DOCUMENTS

| | | | |
|---|---|---|---|
| 1,700,487 | 1/1929 | Crammer | 292/150 |
| 2,233,353 | 2/1941 | Meer et al. . | |
| 2,263,477 | 11/1941 | Voight | 292/150 |
| 2,423,988 | 7/1947 | Lickteig | 292/150 |
| 2,435,238 | 2/1948 | Schlage | 292/150 |
| 2,454,672 | 11/1948 | Rosenthal et al. | 292/150 |
| 2,473,080 | 6/1949 | Vander Henst | 292/150 |
| 2,503,192 | 4/1950 | Cerf, Jr. . | |
| 2,593,573 | 4/1952 | Kulbersh | 292/150 |
| 2,828,152 | 3/1958 | Unetic et al. | 292/150 |
| 4,479,671 | 10/1984 | Colombo | 292/169.14 |

*Primary Examiner*—Eric K. Nicholson

*Attorney, Agent, or Firm*—Harpman & Harpman

[57] ABSTRACT

A safety door latch bolt for use in doors or the like that prevent accidental and unintentional locking of the door. The safety door latch bolt functions in all other respects as a typical standard door lock while providing a fail safe locking mechanism that automatically unlocks the door latch upon closure through the use of an improved locking element and safety release tongue pin.

4 Claims, 2 Drawing Sheets

SAFETY DOOR LATCH BOLT

BACKGROUND OF THE INVENTION

1. Technical Field

This device relates to door latch bolts that are used to selectively secure a typical door within a doorway frame. The door latch bolts have spring-urged tongues that can be retracted within the latch by rotation of a door knob as it will be well known and understood by those skilled in the art.

2. Description of Prior Art

Prior Art devices of this type have relied on a variety of different design configurations, all of which have the same basic required elements for operation including a spring-urged tongue, retraction elements, actuation spindle and attached door knobs, see for example U.S. Pat. Nos. 2,503,192, 2,233,353.

In U.S. Pat. No. 2,233,353 a door latch is disclosed having a lock releasing means from the outside in case of emergency that uses a flat bar inserted through an opening to engage a release mechanism on the locking ear.

In U.S. Pat. No. 2,503,192 a locking jam for spring latch bolts is disclosed wherein a segmented cam is positioned for engagement with a tapered portion of a bolt adjacent the spindle slot restricting movement of same. The cam can be rotated to reset the bolt and locking the latch.

SUMMARY OF THE INVENTION

A safety door latch bolt to prevent the accidental locking of a door by providing a fail safe locking release mechanism that relies on the door closure to unlock. The door lock bolt has a contoured locking element that momentarily engages upon the door closure to effect a locking condition of the door as required.

DESCRIPTION OF THE PREFERRED EMBODIMENT

Figure 1:
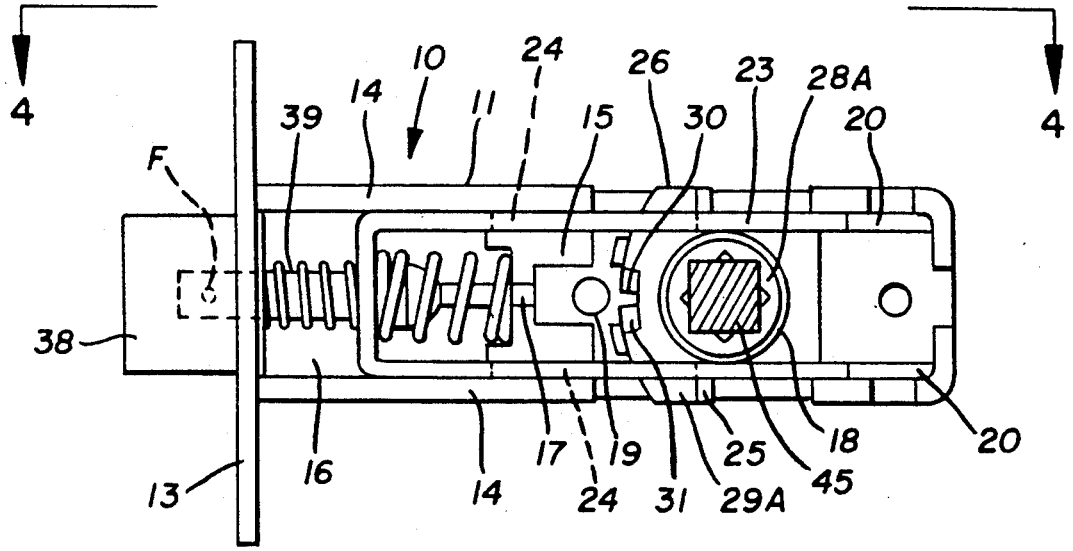
FIG. 1 is a top plan view of one-half of the latch bolt unassembled.
Figure 2:
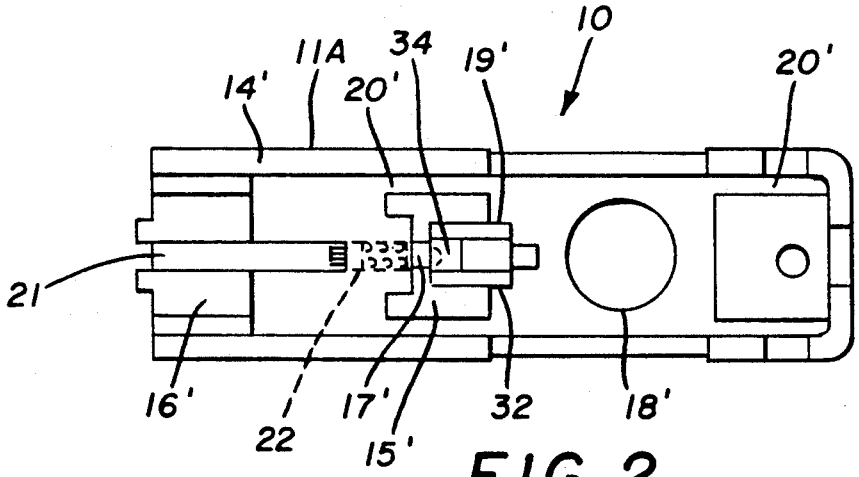
FIG. 2 is a top plan view of the remaining portion unassembled.
Figure 3:
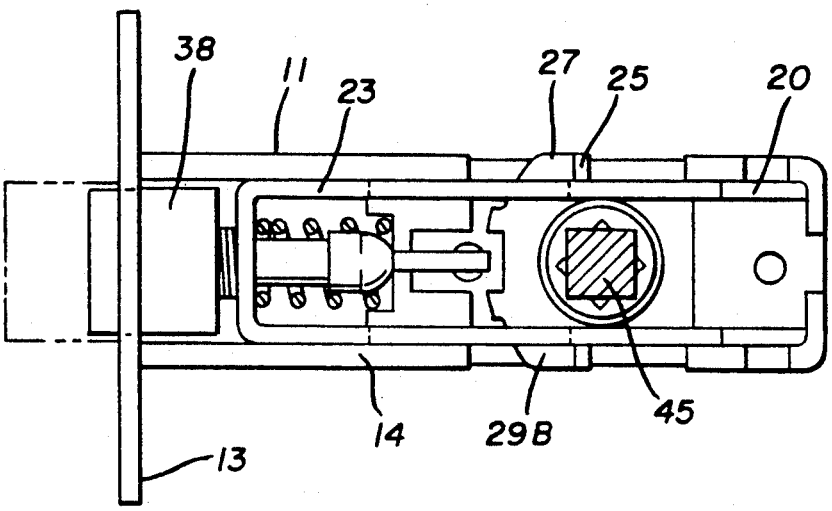
FIG. 3 is a partial sectional view on lines 4—4 of FIG. 1.

Referring to FIGS. 1-3 of the drawings, a lock bolt 10 can be seen having a two-part casting 11 and 11A in which the moving elements of the bolt are positioned. The casting portion 11 is comprised of an elongated half cylindrical shape with an apertured edge plate 13 formed on one end thereof. The casting 11 has spaced upstanding parallel edges 14 with a guide and lock support frame 15 positioned therebetween. The guide and lock support frame 15 has a generally H-shaped configuration extending from the casting's inner surface at 16. A guide pin groove 17 is formed within said frame 15 along the longitudinal axis of said casting 11. A pair of access apertures are formed within the casting 11 at 18 and 19 respectively with a raised surface area spaced in relation to said edges 14 defining guide grooves 20 therebetween at one end of said casting. The casting 11A is of a registering configuration with corresponding elements 14'-17' and 20' as hereinbefore described which will be evident to those familiar within the art.

Figure 5:
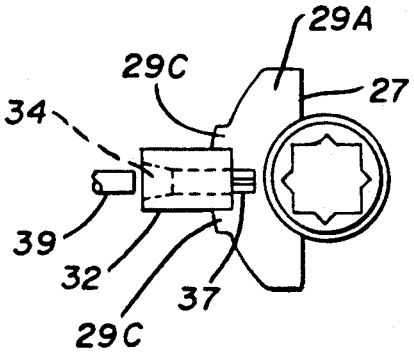
FIG. 5 is a top plan view of a locking engagement portion in locked position.
Figure 6:
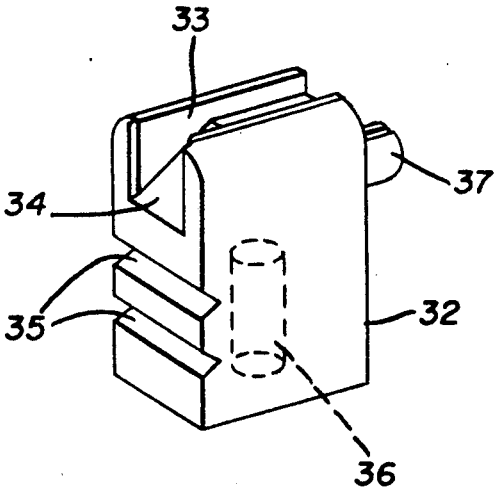
FIG. 6 is an enlarged perspective view of the locking element showing the tapered release surface.

An access groove 21 and aligned bore 22 shown in broken lines are formed within the casting 11A extendinq inwardly from one end thereof. A movable retraction bracket 23 can be seen in FIGS. 1,3, and 4 of the drawings having a generally U-shape configuration with oppositely disposed openings at 24 therein defining a pair of engagement and activation flanges 25. The retraction bracket 23 registers with the guide grooves 20 hereinbefore described. A pair of rotatable activation members 26 and 27 are positioned together within and between said openings at 24 and said access aperture 18 and registering access aperture 18'. Each of said activation members 26 and 27 are of a similar construction and have annular apertured bearing support portions 28A and 28B and arcuate engagement flanges 29A and 29B respectively. The engagement flange 29A has a notch at 30 within a tapered recess portion generally indicated at 31. The engagement flange 29B has a pair of spaced locking tabs 29C extending outwardly therefrom defining a locking recess therebetween which aligns with said lock support frame 15. A movable locking element 32 can best be seen in FIGS. 4,5, and 6 of the drawings having a generally rectangular body member with a recessed center upper portion at 33 which is tapered at 34 defining a pin engagement surface.

The locking element 32 has a pair of spaced parallel V-shaped grooves at 35, a center threaded bore at 36 and a restriction pin 37 extending outwardly opposite said tapered surface. The locking element 32 is movably positioned within said lock support frame 15 and 15' through said registering 19 and 19' apertures in said casting 11 and 11A, best seen in FIGS. 2 and 4 of the drawings.

A bolt tongue 38 is removably secured to a support pin 39 by a fastener F and extends from an opening in the edge plate 13. A support pin 39 has an area of increased transverse dimension at 40 and a reduced area at 41. The area of increased transverse dimension at 40 acts as a stop against the bracket 23 as it passes therethrough while the reduced area at 41 is the safety release mechanism selectively engaging the locking element 32 via the guide 17 and 17'. A pair of springs 42 and 43 are positioned on said support pin 39 on either side of said bracket 23 respectively. The spring 42 maintains the lock tongue 38 in operational position while the spring 43 is seated in the guide and lock support frames 15 and 15'.

In operation, as seen in FIGS. 1 and 3-5 of the drawings, the locking element 32 is moved into the "lock position" via a lock lever 44 that extends from the threaded bore 36 in the locking element 32. The locking element 32 engages the locking recess in the engagement flange 29B of activation member 26 preventing rotation of same via a split spindle 45 and 45' as is well known in the art.

Upon closure of a door (not shown) the locking tongue 38 is momentarily depressed as seen in FIG. 3 of the drawings, advancing the support pin 39 which in turn engages the tapered surface at 34 depressing i.e. (unlocking) the locking element 32 freeing the activation member 26 and its associated portion of the split spindle 45.

Thus, rotation of the activation elements 26 and 27 will engage flanges 25 sliding the bracket 23 in the guides 20 against the spring 34 pulling the support pin 39 with it, retracting and disengaging the bolt tongue 38. As is evident in this design, rotation of the spindle 45' (i.e. inside) would rotate said activation member 26 depressing the pin 39, unlocking the bolt from the inside as is required in lock bolt configurations of this type.

Figure 4:
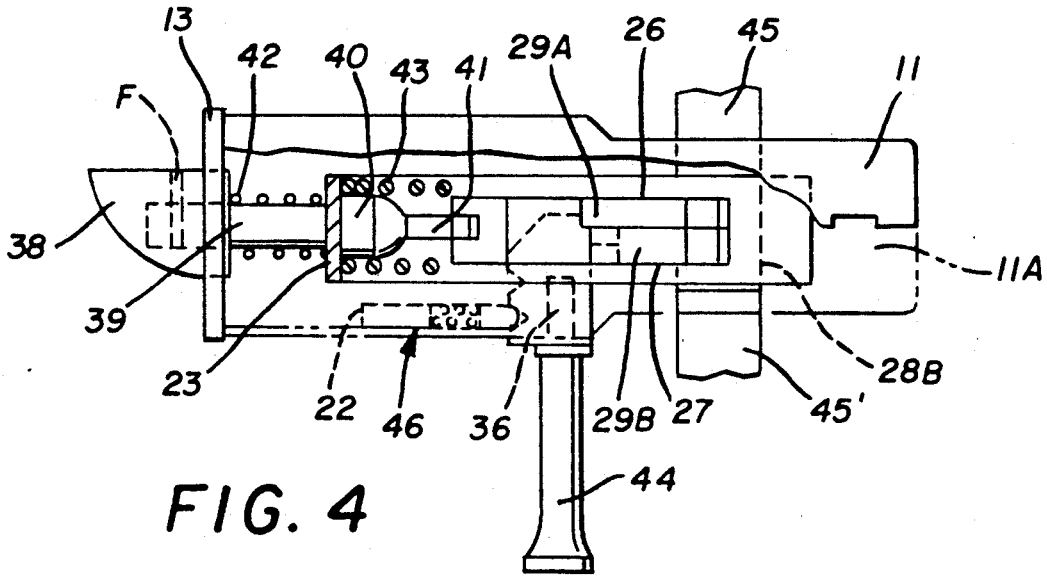
FIG. 4 is a top plan view of one-half of the lock bolt with the tongue release portion retracted.

The locking element 32 is maintained in up (locked) position and down (unlocked) position by a retaining spring and pin assembly 46 in the bore at 22 well known within the art that resiliently engages the selective transverse grooves 35, best seen in FIG. 4 of the drawings.

It will be evident from the above description that the tapered portion at 34 on the locking element 32 is critical to the operation of the lock bolt since it allows a smooth progressive caged engagement of the support pin 39 against the locking element 32 as hereinbefore described.

Thus, it will be seen that a new and useful lock bolt has been illustrated and described and it will be evident to those skilled in the art that various changes and modifications may be made therein without departing from the spirit of the invention, therefore I claim:

1. An improvement in a door lock bolt, said lock bolt comprising a two-part casing, a bolt assembly movably positioned within said casing, a guide lock support frame extending from each of said casings parts, said bolt assembly comprising a retraction bracket, a support pin extending through said bracket, support pin guide grooves in said guide lock support frame, a lock tongue removably secured to said support pin, a pair of activation members having arcuate engagement flanges rotatably positioned with said bracket, a locking element within said support frame, means for selectively engaging each of said activation members, and means for resiliently urging said support pin and said bracket within said casing, the improvement comprising said locking element having an recessed inclined engagement portion, said support pin having areas of increase and decrease transverse dimension abutting one another, with said area of decreased transverse dimension being of equal dimension over its entire length, engagable on said locking element, means for selectively restricting said locking element within said guide lock support frame.

2. The improvement in a door lock bolt of claim 1 wherein said retraction bracket has a pair of oppositely disposed activation flanges engaged by said activation members.

3. The improvement in a door lock bolt of claim 1 wherein said means for selectively engaging said activation members comprises a split shank engageable therethrough.

4. The improvement in a door lock bolt of claim 1 wherein said means for resiliently urging said support pin and said bracket comprises a pair of oppositely disposed springs positioned on said support pin relative said retraction bracket.

* * * * *